US011161354B2

(12) United States Patent
Takehira et al.

(10) Patent No.: US 11,161,354 B2
(45) Date of Patent: Nov. 2, 2021

(54) DRYING DEVICE AND PRINTER INCORPORATING THE DRYING DEVICE

(71) Applicants: Osamu Takehira, Kanagawa (JP); Hirokazu Ikenoue, Tokyo (JP); Yoshiki Yanagawa, Telford England (GB); Amika Sagara, Kanagawa (JP)

(72) Inventors: Osamu Takehira, Kanagawa (JP); Hirokazu Ikenoue, Tokyo (JP); Yoshiki Yanagawa, Telford England (GB); Amika Sagara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 85 days.

(21) Appl. No.: 16/514,610

(22) Filed: Jul. 17, 2019

(65) Prior Publication Data

US 2020/0023655 A1 Jan. 23, 2020

(30) Foreign Application Priority Data

Jul. 23, 2018 (JP) ..... JP2018-137951

(51) Int. Cl.
*F26B 3/32* (2006.01)
*B41J 11/00* (2006.01)
*F26B 13/18* (2006.01)

(52) U.S. Cl.
CPC ..... *B41J 11/002* (2013.01); *F26B 13/18* (2013.01)

(58) Field of Classification Search
CPC ..... B41J 11/057; B41J 11/002; F26B 13/14; F26B 13/18; F26B 13/145; F26B 13/08; F26B 13/002; F26B 13/06; F26B 13/183
USPC ..... 34/520, 519, 345, 343, 113, 95, 514
See application file for complete search history.

(56) References Cited

U.S. PATENT DOCUMENTS

| | | | | |
|---|---|---|---|---|
| 4,875,297 | A * | 10/1989 | Zaoralek | D21G 1/0253 34/550 |
| 8,533,973 | B2 * | 9/2013 | Ulrich | F26B 13/18 34/388 |
| 2003/0058320 | A1 * | 3/2003 | Sano | G03G 15/2003 347/103 |
| 2016/0101635 | A1 | 4/2016 | Hoshino et al. | |
| 2016/0313059 | A1 * | 10/2016 | Boland | F26B 13/14 |
| 2017/0157951 | A1 * | 6/2017 | Onodera | B41J 11/002 |
| 2017/0173974 | A1 | 6/2017 | Hoshino et al. | |
| 2017/0266991 | A1 | 9/2017 | Onodera et al. | |
| 2017/0334217 | A1 | 11/2017 | Yoshinuma et al. | |
| 2018/0009237 | A1 | 1/2018 | Sakamoto et al. | |
| 2018/0141348 | A1 | 5/2018 | Hoshino et al. | |

FOREIGN PATENT DOCUMENTS

| | | |
|---|---|---|
| JP | 2006-290389 | 10/2006 |
| JP | 2017-207250 | 11/2017 |
| JP | 2018-012323 | 1/2018 |
| JP | 2018-066552 | 4/2018 |

* cited by examiner

*Primary Examiner* — John P McCormack
(74) *Attorney, Agent, or Firm* — Duft & Bornsen, PC

(57) ABSTRACT

A drying device includes one or more first heating bodies configured to heat a drying target object conveyed with liquid applied on the drying target object, and a second heating body configured to heat the drying target object after the drying target object is heated by the one or more first heating bodies. The one or more first heating bodies include at least one heating body configured to heat the drying target object at a heating temperature greater than a heating temperature of the second heating body.

9 Claims, 5 Drawing Sheets

FIG. 5

| DRYING DATA TABLE | | | | | | | | |
|---|---|---|---|---|---|---|---|---|
| MEDIA NAME | MEDIA WEIGHT | PRINT SPEED | HEAT DRUM 12 | HEAT ROLLER 11A | HEAT ROLLER 11B | ··· | HEAT ROLLER 11I | HEAT ROLLER 11J |
| COATED PAPER 1 | 90gsm | 50m/min. | 100°C | 100°C | 100°C | ··· | 100°C | 100°C |
| | | 75m/min. | 100°C | 110°C | 110°C | ··· | 100°C | 100°C |
| | | 100m/min. | 100°C | 120°C | 120°C | ··· | 110°C | 100°C |
| | | 120m/min. | 120°C | 130°C | 130°C | ··· | 120°C | 120°C |
| | 130gsm | 50m/min. | 100°C | 110°C | 110°C | ··· | 100°C | 100°C |
| | | 75m/min. | 100°C | 120°C | 120°C | ··· | 110°C | 110°C |
| | | 100m/min. | 120°C | 140°C | 140°C | ··· | 130°C | 130°C |
| | | 120m/min. | 120°C | 140°C | 140°C | ··· | 140°C | 140°C |
| | 200gsm | 50m/min. | 120°C | 130°C | 130°C | ··· | 130°C | 130°C |
| | | 75m/min. | 140°C | 140°C | 140°C | ··· | 140°C | 140°C |
| | | 100m/min. | 140°C | 150°C | 150°C | ··· | 150°C | 150°C |
| | | 120m/min. | 140°C | 160°C | 160°C | ··· | 160°C | 160°C |
| COATED PAPER 2 | 90gsm | ··· | ··· | ··· | ··· | ··· | ··· | ··· |
| | 130gsm | ··· | ··· | ··· | ··· | ··· | ··· | ··· |
| | 200gsm | ··· | ··· | ··· | ··· | ··· | ··· | ··· |
| PLAIN PAPER | 70gsm | ··· | ··· | ··· | ··· | ··· | ··· | ··· |

DRYING DEVICE AND PRINTER INCORPORATING THE DRYING DEVICE

CROSS-REFERENCE TO RELATED APPLICATION

This patent application is based on and claims priority pursuant to 35 U.S.C. § 119(a) to Japanese Patent Application No. 2018-137951, filed on Jul. 23, 2018, in the Japan Patent Office, the entire disclosure of which is hereby incorporated by reference herein.

BACKGROUND

Technical Field

This disclosure relates to a drying device and a printer incorporating the drying device.

Related Art

Printers that apply liquid onto a continuous sheet to form images on the continuous sheet include a heating unit to dry the images after application of liquid to the continuous sheet.

A known drying device includes multiple heat rollers, each having a small diameter, to heat a continuous sheet, and a heat drum having a large diameter to heat the continuous sheet that has been heated by the multiple heat rollers.

SUMMARY

At least one aspect of this disclosure provides a drying device including one or more first heating bodies configured to heat a drying target object conveyed with liquid applied on the drying target object, and a second heating body configured to heat the drying target object after the drying target object is heated by the one or more first heating bodies. The one or more first heating bodies including at least one heating body configured to heat the drying target object at a heating temperature greater than a heating temperature of the second heating body.

Further, at least one aspect of this disclosure provides a printer including a liquid applier to apply liquid to a drying target object, and the above-described application.

BRIEF DESCRIPTION OF THE SEVERAL VIEWS OF THE DRAWINGS

An exemplary embodiment of this disclosure will be described in detail based on the following figured, wherein:

FIG. 5 is a diagram illustrating an example of a drying data table.

DETAILED DESCRIPTION

Figure 1:
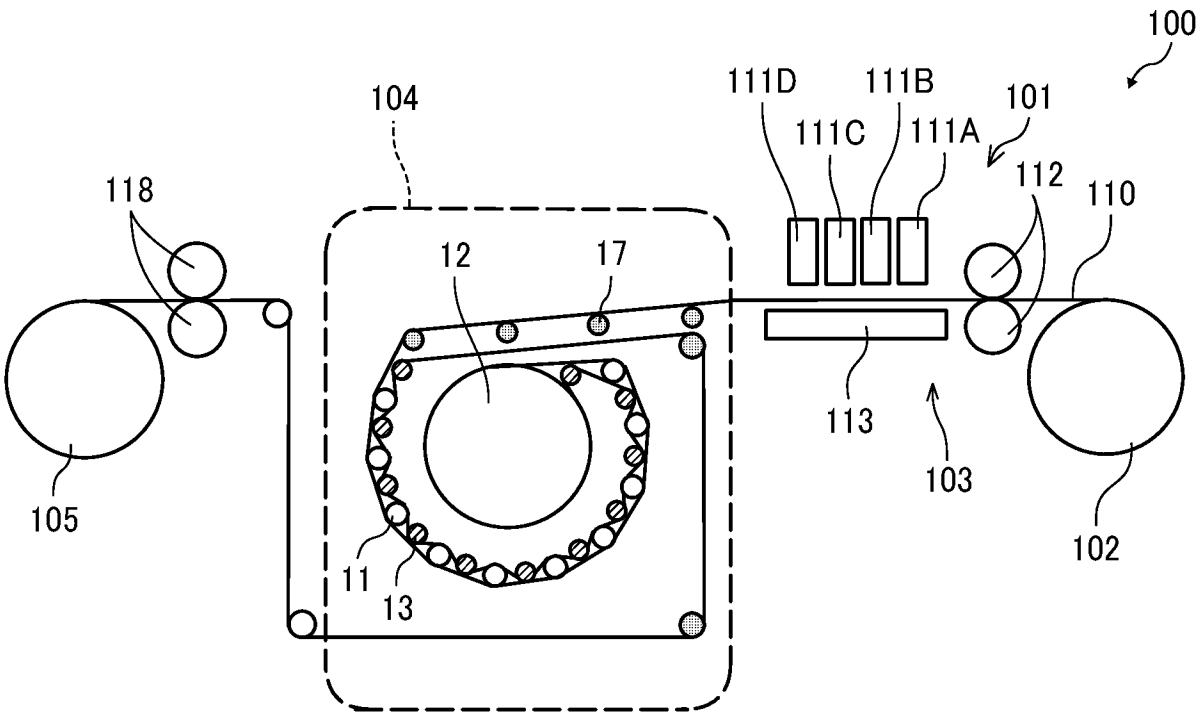
FIG. 1 is a schematic diagram illustrating a printer (image forming apparatus) according to Embodiment 1 of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any drying device, and is implemented in the most effective manner in an inkjet image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an embodiment applicable to a drying device and a printer incorporating the drying device, with reference to the following figures.

It is to be noted that elements (for example, mechanical parts and components) having the same functions and shapes are denoted by the same reference numerals throughout the specification and redundant descriptions are omitted.

First, a description is given of a printer 100 according to Embodiment 1, with reference to FIG. 1.

FIG. 1 is a schematic diagram illustrating the printer 100 according to Embodiment 1 of this disclosure.

It is to be noted in the following examples that: the term "printer" indicates an apparatus in which an image is printed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the printer 100 is an inkjet recording apparatus and includes a liquid application device 101 including liquid discharge heads 111 as a liquid applicator to discharge and apply an ink which is a liquid of a given color to a continuous sheet 110 that functions as an object to be conveyed as a drying target object.

For example, the liquid application device 101 has full line type liquid discharge heads 111 (i.e., full line type liquid discharge heads 111A, 111B, 111C, and 111D) for four colors aligned from an upstream side of a sheet conveying direction of the continuous sheet 110. The full line type liquid discharge heads 111A, 111B, 111C, and 111D apply liquids of black (K), cyan (C), magenta (M), and yellow (Y) to the continuous sheet 110, respectively. The types and the number of colors are not limited to the above-described configuration.

The continuous sheet 110 is fed out from a feed roller 102 and is conveyed by a pair of sheet conveying rollers 112 of a conveying unit 103, onto a sheet conveyance guide 113 that is disposed facing the liquid application device 101. Then, the continuous sheet 110 is guided by the sheet conveyance guide 113 to be further conveyed (moved).

The continuous sheet 110 to which a liquid has been applied by the liquid application device 101 passes through a drying device 104 according to an embodiment of the present embodiment. Then, the continuous sheet 110 is further conveyed by a pair of sheet ejecting rollers 118 to be taken up by a take-up roller 105.

Figure 2:
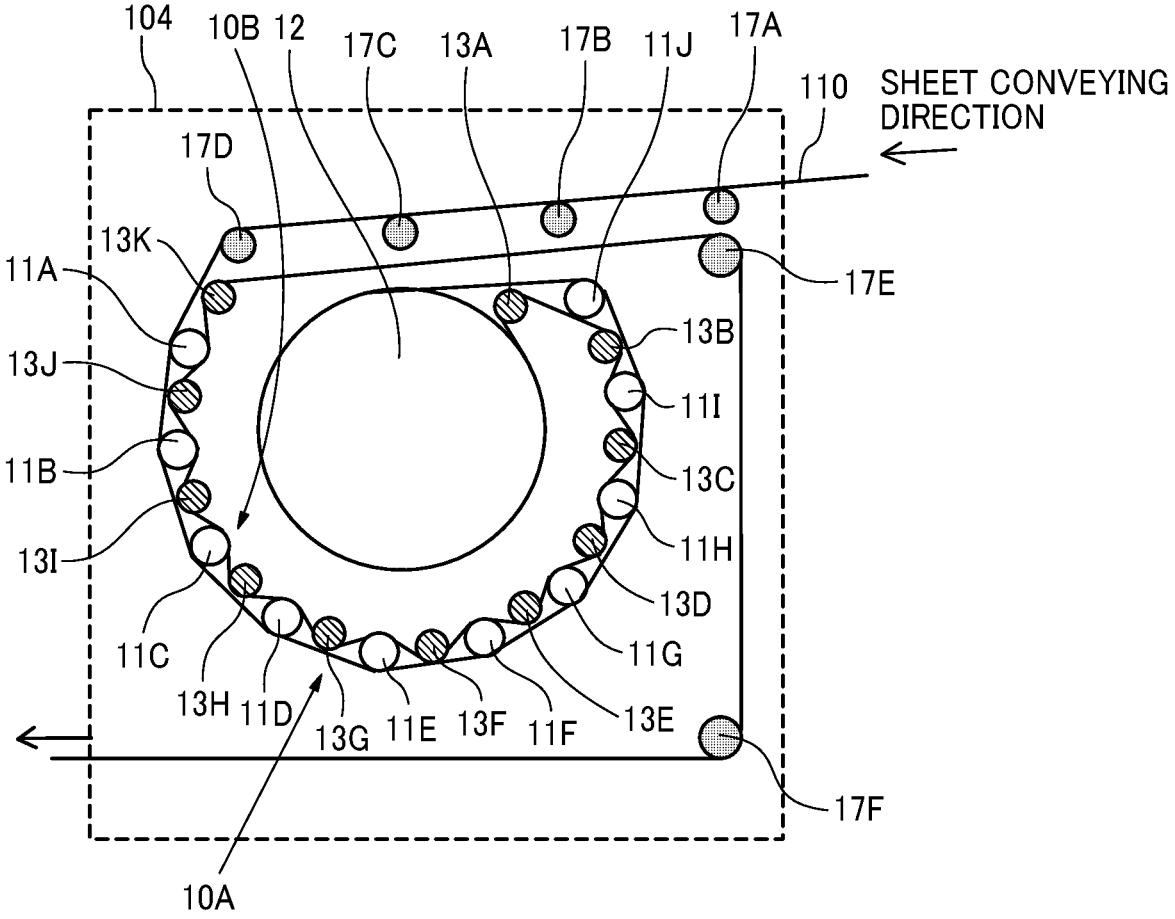
FIG. 2 is an enlarged view illustrating a drying device according to Embodiment 1.

Next, a description is given of the drying device 104 according to Embodiment 1 of this disclosure, with reference to FIG. 2.

FIG. 2 is an enlarged view illustrating the drying device 104 according to Embodiment 1.

The drying device 104 includes multiple heat rollers 11 (i.e., heat rollers 11A to 11J) and a heat drum 12. The multiple heat rollers 11A to 11J function as one or more first heating bodies, also as multiple contact type heating bodies, each having a curve-shaped contact face to heat the continuous sheet 110 by contacting the continuous sheet 110. The heat drum 12 functions as a second heating body, also as a contact type heating body having a curve-shaped contact face. It is to be noted that each of the multiple heat rollers 11A to 11J has a diameter smaller than the diameter of the heat drum 12. It is also to be noted that the multiple heat rollers may have respective diameters identical to each other or different from each other.

The drying device 104 further includes guide rollers 13A to 13K. Specifically, the guide roller 13A is disposed downstream from the heat drum 12 in the sheet conveying direction and functions as a contact guide to guide the continuous sheet 110 to the heat roller 11J. The guide rollers 13B to 13K function as contact guides to guide the continuous sheet 110, which has been guided by the guide roller 13A, to contact the heat rollers 11I to 11A.

Here, the multiple heat rollers 11A to 11J are disposed in a substantially arc shape around the heat drum 12. It is to be noted that the diameters of the multiple heat rollers 11A to 11J may be identical to each other or different from each other. Further, each of the guide rollers 13B to 13J is disposed between two adjacent heat rollers 11.

The multiple heat rollers 11 (i.e., the heat rollers 11A to 11J), the heat drum 12, and the multiple guide rollers 13 (i.e., the guide rollers 13A to 13K) form a sheet heating and conveying passage (in other words, a sheet conveyance passage, including a first heating passage 10A and a second heating passage 10B described below) to heat the continuous sheet 110. The continuous sheet 110 is conveyed while contacting respective outer circumferential surfaces of the multiple heat rollers 11 disposed in a substantially arc shape, upstream from the heat drum 12 in the sheet conveying direction. After passing the heat drum 12, the continuous sheet 110 is guided by the multiple guide rollers 13 to be conveyed while contacting respective inner circumferential surfaces of the multiple heat rollers 11.

Further, the drying device 104 further includes guide rollers 17A to 17F. Specifically, the guide rollers 17A to 17D guide the continuous sheet 110 to be fed to the heat roller 11A in the drying device 104. The guide rollers 17E and 17F guide the continuous sheet 110 that has passed the guide roller 13K to the outside of the drying device 104, in other words, to eject from the drying device 104.

As a flow of drying in the drying device 104 as described above, the heat rollers 11 heat the opposite face of the continuous sheet 110, which is a face opposite a liquid applied face of the continuous sheet 110, while contacting the opposite face of the continuous sheet 110.

Next, the heat drum 12, which is disposed inside the arrangement of the substantially arc shape of the multiple heat rollers 11, heats the opposite face of the continuous sheet 110 while the opposite face of the continuous sheet 110 is contacting the heat drum 12.

Thereafter, while the guide rollers 13 are contacting the liquid applied face of the continuous sheet 110, the heat rollers 11 contact the opposite face of the continuous sheet 110 to heat the continuous sheet 110. According to this configuration, the liquid applied to the continuous sheet 110 is dried.

Specifically, in the present embodiment, the multiple heat rollers 11 (i.e., the heat rollers 11A to 11J), to which the continuous sheet 110 contacts in a first path of conveyance of the continuous sheet 110, define the first heating passage 10A through which a drying target object (i.e., the continuous sheet 110) is dried.

Further, the multiple heat rollers 11 (i.e., the heat rollers 11A to 11J), to which the continuous sheet 110 contacts again in a second path of the conveyance of the continuous sheet 110 after passing the heat drum 12, define the second heating passage 10B. When heating the continuous sheet 110 in the second heating passage 10B, the multiple guide rollers 13 contact the liquid applied face of the continuous sheet 110 to guide the continuous sheet 110 that functions as a drying target object.

Further, in the present embodiment, as described above, the continuous sheet 110 that functions as a drying target object is heated in the first heating passage 10A and the second heating passage 10B by contacting the multiple heat rollers 11 for two times (i.e., the first path and the second path), at different portions or points of the respective heat rollers 11. For example, the continuous sheet 110 contacts a portion of each of the heat rollers 11 in the first heating passage 10A and also contact a different portion of each of the heat rollers 11 in the second heating passage 10B.

In addition, in the present embodiment, at least one of the heat rollers 11 has a heating temperature higher or greater than the heating temperature of the heat drum 12 that functions as a second heating body.

In a comparative configuration, when increasing a heating temperature of a heating unit for heating a drying target in order to reduce a drying time, if the heating temperature is too high, the drying target turns yellow or liquid applied to the drying target peels off in the middle of a drying process of the drying target.

By contrast, according to the configuration of the present embodiment, the temperature of the continuous sheet 110 that is heated by the heat rollers 11 becomes closer to the heating temperature of the heat drum 12. Therefore, the heat drum 12 performs an effective drying, and even if the drying speed (the conveying speed) of the continuous sheet 110 is increased, the drying device 104 dries the continuous sheet 110 sufficiently. Accordingly, a reduction in drying time is achieved.

The liquid (ink) used in the present embodiment preferably has the following characteristics.

Viscosity: Within a range of 5.0 [mPa·s] to 12.0 [mPa·s] under the conditions of Temperature: 24±2° C., more preferably within a range of 8.0 [mPa·s] to 9.0 [mPa·s].

Surface Tension (Static): 30 [mN/m] or less under the conditions of Temperature: 24±2° C., preferably within a range of from 20 [mN/m] to 26 [mN/m].

Water Evaporation (30%): The viscosity is 100 [mPa·s] or less at 30 wt % of water evaporation, more preferably, 40 [mPa·s] or less.

Water Evaporation (40%): The viscosity is 300 [mPa·s] or less at 40 wt % of water evaporation, more preferably, 120 [mPa·s] or less.

Simple Deposition Evaluation: Accumulated deposition height less than 15 mm under the conditions of Drying Conditions: 32° C. 30% RH, Dropping Speed: 1 drop/30 min., and Dropping Time: after 48 hours from printing, and more preferably, less than 5.5 mm of accumulated deposition height.

Hardness: 0.07 or greater under the conditions of Temperature: 23±2° C., Humidity: 50-60% RH, Depth of Press: 200 nm (40 nm/s), and after 20 hours (or more) from printing, more preferably, 0.21±0.12.

Elastic Modulus: 1.1 or greater under the conditions of Temperature: 23±2° C., Humidity: 50-60% RH, Depth of Press: 200 nm (40 nm/s), and after 20 hours (or more) from printing, more preferably, 5.8±2.4.

The ink as a liquid is prepared by mixing, for example, black pigment dispersion of 50.00 (percent) by mass (pigment solid content concentration 16 (percent)), a polyethylene wax AQUACER 531 of 2.22 (percent) by mass (nonvolatile matter 45 (percent) by mass, manufactured by BYK Japan KK)), 3-ethyl-3-hydroxymethyloxetane of 30.00 (percent) by mass, propylene glycol monopropyl ether of 10.0 (percent) by mass, silicone-based surfactant of 2.00 (percent) by mass (TEGO Wet 207, manufactured by Tomoe Engineering Co., Ltd.), and ion-exchange water, so that the amount of the above-described materials equals to the remaining amount. After these materials are dispersed for one hour, the ink is obtained by filtering by a membrane filter having an average pore diameter of 1.2 μm.

Figure 3:
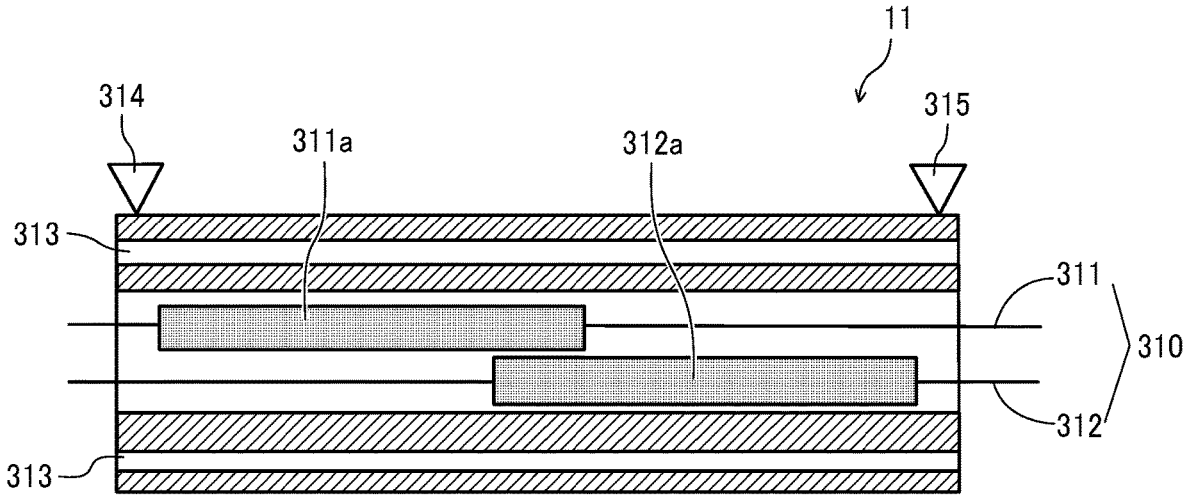
FIG. 3 is a cross sectional view illustrating an example of a heat roller.

Next, a description is given of an example of the heat rollers 11, with reference to FIG. 3. Hereinafter, the heat rollers 11 are also referred to in a singular form to describe the details with reference to FIG. 3.

FIG. 3 is a cross sectional view illustrating an example of the heat roller 11.

The heat roller 11 incorporates two halogen lamps, which are a halogen lamp 311 and a halogen lamp 312, as a heat source 310. The halogen lamp 311 has a first light emitting area 311*a*, and the halogen lamp 312 has a second light emitting area 312*a*.

The first light emitting area 311*a* and the second light emitting area 312*a* are not the entire area of the heat roller 11 in the axial direction of the heat roller 11, but an area greater than half the length of the heat roller 11. The first light emitting area 311*a* and the second light emitting area 312*a* overlap each other at the axial center of the heat roller 11.

Further, the halogen lamp 311 and the halogen lamp 312 have different heating points but have the same amount of heat supplied per unit length. It is to be noted that the heat roller 11 according to the present embodiment employs the halogen lamp 311 and the halogen lamp 312, and the amount of heat supplied per unit length of each of the halogen lamp 311 and the halogen lamp 312 in an area with overlapping of the first light emitting area 311*a* and the second light emitting area 312*a* is equal to half the amount of heat supplied to an area with no overlapping of the first light emitting area 311*a* and the second light emitting area 312*a*.

The heat roller 11 incorporates a heat pipe 313 in the heat roller 11 in order to make a uniform temperature distribution in the axial direction of the heat roller 11. According to the effect of the heat pipe 313, the heat roller 11 is heated uniformly up to each end of the heat roller 11 in the axial direction.

The heat roller 11 further includes thermopiles 314 and 315, each of which functions as a first temperature detector of non-contact type, in other words, a non-contact type first temperature detector. The thermopile 314 detects the temperature of the halogen lamp 311 based on the surface temperature of the heat roller 11, and the thermopile 315 detects the temperature of the halogen lamp 312 based on the surface temperature of the heat roller 11.

Figure 4:
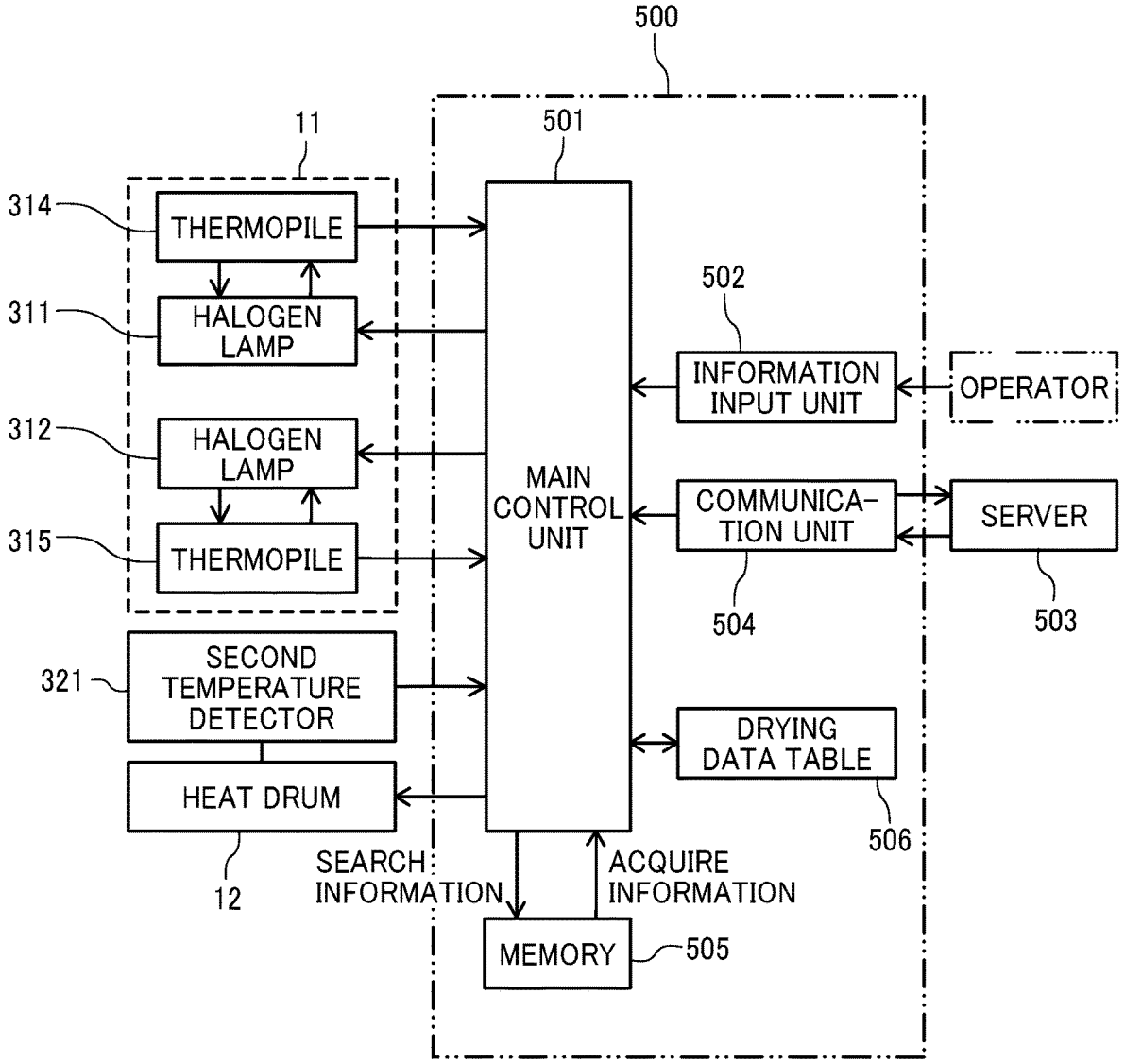
FIG. 4 is a block diagram illustrating an example of a controller of the drying device.

Next, a description is given of an example of a controller of the drying device 104, with reference to FIGS. 4 and 5.

FIG. 4 is a block diagram illustrating an example of a controller 500 of the drying device 104. FIG. 5 is a diagram illustrating an example of a drying data table.

The controller 500 functions as circuitry and includes a main control unit 501 such as a personal computer that controls the drying device 104 entirely. The controller 500 controls the heating temperature of each of the heat rollers 11 (i.e., the heat rollers 11A to 11J) and the heating temperature of the heat drum 12.

The main control unit 501 controls output of the halogen lamp 311 based on the detection result of the thermopile 314 and output of the halogen lamp 312 based on the detection result of the thermopile 315, so as to adjust the heating temperature of each of the heat rollers 11 to a target heating temperature.

The main control unit 501 controls the heating temperature of the heat drum 12 to the target heating temperature, based on the detection result of the temperature of the heat drum 12 detected by the second temperature detector 321.

The controller 500 also includes an information input unit 502 that inputs information of the drying target object (i.e., the continuous sheet 110) by an operator or operators. The controller 500 further includes a communication unit 504 that searches a server 503 through communication and obtains information of the drying target object (i.e., the continuous sheet 110) from the server 503. The information obtained or input is stored in a memory 505, so that the information is easily read out.

As illustrated in FIG. 5, the controller 500 further includes a drying data table 506 in which data related to types of the continuous sheet 110 (media names), the weight of the continuous sheet 110 (media weight), printing speeds (in other words, conveying speeds) of the continuous sheet 110, the target heating temperature of the heat drum 12, and the target heating temperatures of the heat rollers 11.

Then, as the type and the weight of the continuous sheet 110 to be used are selected by the operator via the information input unit 502, information related to the target heating temperature of each of the heat rollers 11A to 11J and the target heating temperature of the heat drum 12 are obtained from the drying data table 506 based on information related to the printing speed that is set separately from the input information.

Next, the controller 500 controls turning on and off of each of the halogen lamp 311 and the halogen lamp 312 based on the information related to the target heating temperature of each of the heat rollers 11A to 11J and the target heating temperature of the heat drum 12, so that the surface temperature (heating temperature) of each of the heat rollers 11 equals to the target heating temperature based on the target heating temperature information, and causes the surface temperature (heating temperature) of the heat drum 12 to reach the target heating temperature of the heat drum 12. It is to be noted that, in a case in which there is no corresponding information in the drying data table 506, the operator may register a setting value.

Here, as illustrated in the drying data table 506 of FIG. 5, the heat rollers 11A to 11J include one or more heat rollers having a heating temperature higher or greater than the heating temperature of the heat drum 12.

For example, in a case in which the media name is coated paper 1, the weight of media is 90 gsm (grams per square meter), and the printing speed is 75 m/min. (meters per minute), the heating temperatures of the heat rollers 11A and 11B are set to 110° C. (degrees Celsius) while the heating temperature of the heat drum 12 is set to 100° C. The heat rollers 11I and 11J have the heating temperature same as the heating temperature of the heat drum 12.

By contrast, in a case in which the media name is coated paper 1, the weight of media is 130 gsm, and the printing speed is 100 m/min., the heating temperatures of upstream side heat rollers, which are the heat rollers disposed on an upstream side in the sheet conveying direction including the heat rollers 11A and 11B, are set to 140° C. and the heating temperatures of downstream side heat rollers, which are the heat rollers disposed on a downstream side in the sheet conveying direction including the heat rollers 11I and 11J, are set to 130° C., while the heating temperature of the heat drum 12 is set to 120° C.

Further, in a case in which the media name is coated paper 1, the weight of media is 200 gsm, and the printing speed is 100 m/min., the heating temperatures of the heat rollers 11A to 11J are set to 150° C. while the heating temperature of the heat drum 12 is set to 140° C.

Similarly, as illustrated in FIG. 5, the drying data table 506 also includes data related to coated paper 2 and plain paper even though the detailed data of coated paper 2 and plain paper are omitted.

As described above, the multiple upstream side heat rollers 11, which heat the continuous sheet 110 on the upstream side from the heat drum 12 in the sheet conveying direction, includes the heat rollers 11 having the heating temperature higher than the heating temperature of the heat drum 12. It is to be noted that, in a case in there is a single heat roller 11 (in other words, one heat roller 11) is provided to the drying device 104, the heating temperature of the single heat roller 11 is set to be greater than the heating temperature of the heat drum 12.

As described above, according to this configuration, the temperature of the continuous sheet 110 that is conveyed to the heat drum 12 is adjusted to be closer to or equal to the heating temperature of the heat drum 12, and therefore the heat drum 12 provides efficient heating to the continuous sheet 110. Accordingly, the conveying speed of the continuous sheet 110 is increased to reduce the drying time.

Specifically, in order to increase the printing speed to enhance the printing productivity, it is easy to increase the drying heat increase the printing speed and improve the printing productivity, it is easy to increase the amount of drying heat, that is, the heating temperature of the heat roller or heat rollers. However, the following inconveniences (problems) occur due to an excessive increase in temperature, and therefore it is found that there is a limit to increase the heating temperature of the heat roller.

(1) When printing on an offset coated paper, depending on the type of a sheet, the sheet turns yellow when heated at or above the heating temperature of 180° C. to 200° C. Therefore, the print quality deteriorates.

(2) The temperature of the heat roller (and the heat drum) having a relatively large diameter increases easily due to accumulation of heat at a flange or flanges of the heat roller when compared with a cylindrical portion (on which heat transfer occurs to heat the sheet) of the heat roller. When the temperature approaches to 200° C., the Young's modules decreases, and therefore the strength of the heat roller becomes insufficient. As a result, thermal fatigue fracture progresses.

In addition to increasing the printing speed, when printing on a thick continuous sheet, the greater amount of drying heat greater is used in comparison to the amount of drying heat used when printing on a thin continuous sheet. However, the configuration of a drying device has an upper limit of power to be applied, and therefore the configuration is made to provide constant or stable drying quality with the upper limit when drying from the thin continuous sheet to the thick continuous sheet.

Further, when the temperature of a resin, which is prepared as ink composition to improve the scratch resistance of liquid film (ink film) after drying, increases in a drying process, the resin is softened depending on the amount of organic solvent remaining in the dried film of liquid. Therefore, when the roller and the ink film contact to each other, the ink film is broken when transferred to the roller. As a result, voids occur on the image.

This inconvenience is a new side effect caused by the high temperature of the heat roller to increase the printing speed.

To be more specific in this point, in a case in which the heat drum 12 and the heat rollers 11, each of which is made of aluminum material, are controlled to have the heating temperature of 120° C. to dry the continuous sheet, occurrence of irregular or erroneous images with white dots of less than 1 mm (hereinafter, referred to as "void" or "voids") was confirmed after the continuous sheet has continuously been printed for 10 minutes or so. By observing the voids, it was found that the ink film was peeled off and the background of the continuous sheet was exposed. Then, in order to examine the portion in which the voids occur, the device was forcibly stopped during the printing operation and the printing face of the continuous sheet and the surface of the heat roller were checked. As a result, the voids were found from the guide roller 13K to the guide roller 13D (that is, the guide rollers 13K, 13A, 13B, 13C, and 13D this order) and no voids were found after the guide roller 13E. Moreover, the dot-shaped ink was adhered to the surfaces of the guide rollers 13K, 13A, 13B, 13C, and 13D. Moreover, when the change in the temperature of the guide rollers 13 was measured, the temperature went up immediately after the start of the printing operation, and reached the temperature of 100° C. after 10 minutes from the start of the printing operation. In addition, it was confirmed that, as the printing speed increased, the area in which the voids had occurred was expanded to the guide rollers 13 disposed on the downstream side in the sheet conveying direction. Even when the amount of ink adhered to the surfaces of the guide rollers 13 is increased, the same tendency was observed.

This fact had been studied and found that, if a member such as the roller having the temperature of 100° C. or above contacts the ink film in the process in which water and organic solvent evaporate from the ink film, the resin contained in the ink is softened, the tack force on the surface of the ink film is increased, and the strength of the ink film is decreased. Then, the ink film in the dry state is broken and easily transferred to the surface of the member, which generates voids. However, it was found that, when the drying further progresses to exceed the threshold, even if the temperature of the member is relatively high, neither the resin becomes soft nor the voids occur.

According to this result, the heating temperature of the first heating body is set to be greater than the heating temperature of the second heating body, so that the temperature of the drying target object is increased to be close or equal to the heating temperature of the second heating body. By so doing, the drying target object is efficiently dried by heating by the second heating body.

In this case, even in a case in which not each heating temperature of the first heating bodies is greater than the heating temperature of the second heating body, the temperature of the drying target object that has previously been increased is maintained to some extent. Therefore, by setting the heating temperature of some of the first heating bodies higher than the heating temperature of the second heating body, the temperature of the drying target object is increased to be close or equal to the temperature of the second heating body member. Accordingly, a power-saving is achieved.

In addition, the side effect caused by raising the heating temperature of the first heating bodies and the heating temperature of the second heating body due to an increase in the drying speed (i.e., occurrence of void due to an increase in temperature of the guide roller and softening of the ink film in the process of drying) is restrained by enhancing the release property of the surface of the guide roller.

Next, a description is given of specific examples.

The drying device 104 is provided with the heat drum 12 having an outer diameter of 560 mm, the heat rollers 11A to 11J (i.e., 10 heat rollers) having an outer diameter of 84 mm, disposed around the heat drum 12. The central axes of rotation of the heat rollers 11 are arranged in a substantially concentric circle having a radius of 485 mm from the rotational center of the heat drum 12. The guide rollers 13B to 13K having an outer diameter of 64 mm are disposed adjacent to the heat rollers 11A to 11J, so that the rotation centers of the guide rollers 13B to 13K are arranged in a substantially concentric circle having a radius of 457 mm from the rotational center of the heat drum 12. Further, the guide roller 13K that guides the continuous sheet 110 conveyed out from the heat drum 12, to the heat roller 11J is disposed at a position illustrated in FIG. 2.

With this layout, the distances of which the continuous sheet 110 contacts each of the heat rollers 11 disposed upstream from the heat drum 12 in the sheet conveying direction are about 18 mm for each of the heat rollers 11A to 11I and 48 mm for the heat roller 11J and the distances of which the continuous sheet 110 contacts each of the heat rollers 11 disposed downstream from the heat drum 12 in the sheet conveying direction are about 44 mm for each of the heat rollers 11A to 11I.

When the total distance of which the continuous sheet 110 contacts each of the heat rollers 11 disposed upstream from the heat drum 12 in the sheet conveying direction corresponds to the heating distance of the first heating passage, the heating distance of which the continuous sheet 110 contacts the heat drum 12 corresponds to the heating distance of the heat drum 12, and the total distance of which the continuous sheet 110 contacts each of the heat rollers 11 disposed downstream from the heat drum 12 in the sheet conveying direction corresponds to the heating distance of the second heating passage, these distances are indicated as follows.

Heating Distance of First Heating Passage: 200 mm.

Heating Distance of Heat Drum 12: 1455 mm.

Heating Distance of Second Heating Passage: 400 mm.

Occurrence of voids when dried by the drying device 104 was observed. In order to quantify the occurrence of voids, a portion of a predetermined size at an arbitrary position of a printed image was read by a scanner at a resolution of 600 dpi, so that the printed image was binarized with a predetermined threshold, and the rate by which the pixels of the printed image are white (i.e., an area ratio %) was obtained as void ratio. If the void ratio is 0.03% or smaller, ink peeling was not observed visually, and therefore the image was evaluated as an image without defect. Accordingly, when the void ratio is 0.03% or smaller, it is indicated as "Good". By contrast, when the void ratio exceeds 0.03%, it is indicated as "Not Good."

The properties of the liquid (ink) used are within the range described above, and the thermal properties of the ink used are within the following ranges. Density: 1020 to 1070 $kg/m^3$, Specific heat: 3200 to 3500 J/(kg·K).

With this ink, a solid image of about 1 $\mu l/cm^2$, at a resolution of 1200 dpi was printed while conveying a roll sheet (i.e., the continuous sheet 110) of Lumi Art Gloss having 130 gsm with the sheet width of 520.7 mm (manufactured by Stora Enso) at a predetermined speed, and the drying test was performed under the above-described conditions. The guide roller 13 was made of aluminum and the surface of the guide roller 13 was also aluminum.

Drying Standard Conditions.

Conveying Speed: 75 m/min.

Heating Temperature of Heat Rollers 11: 120° C. each.

Heating Temperature of Heat Drum 12: 120° C.

Void: Good.

Evaluation Test 1.

The conveying speed was set to 120 m/min., and the temperature of the heat drum was set to 120° C. entirely through Evaluation Test 1. Evaluation Test 1 was conducted by drying the sheet with the above-described values of the conveying speed and the temperature of the heat drum, under the conditions described in Table 1 to observe voids. Table 1 indicates the results of the void ratio.

TABLE 1

| | | | | | |
|---|---|---|---|---|---|
| Conveyance Speed (Unit: m/min.) | 75 | 120 | 120 | 120 | 120 |
| Temperature of Heat Drum (Unit: ° C.) | 120 | 120 | 120 | 120 | 120 |
| Temperature of Heat Rollers (Unit: ° C.) | 120 | 120 | 140 | 150 | 160 |
| Void Ratio | Good | Not Good | Not Good | Not Good | Good |

From the results of Table 1, it is found that, in a case in which the temperatures of the heat rollers 11 are increased above the heating temperature of the heat drum 12, the same drying quality (i.e., "Good" in the void ratio) is obtained when the printing speed (i.e., the conveying speed) of the sheet is increased from 75 m/min. to 120 m/min.

Evaluation Test 2.

Next, Evaluation Test 2 was conducted by drying the sheet with the roll sheet that is replaced to Lumi Art Gloss having 250 gsm with the sheet width of 520.7 mm (manufactured by Stora Enso Japan KK), under the conditions described in Table 2 to observe voids. Table 2 indicates the results of the void ratio.

TABLE 2

| | | | | |
|---|---|---|---|---|
| Weight of Roll Sheet (Unit: gsm) | 130 | 250 | 250 | 250 |
| Conveying Speed (Unit: m/min.) | 75 | 75 | 75 | 75 |
| Temperature of Heat Drum (Unit: ° C.) | 120 | 120 | 120 | 120 |
| Temperature of Heat Rollers (Unit: ° C.) | 120 | 120 | 130 | 140 |
| Void Ratio | Good | Not Good | Not Good | Not Good |

It is found from the results indicated in Table 2 that, when the sheet is replaced to thick paper, the temperatures of the heat rollers 11 are set to be higher than the temperature of the heat drum 12, so that the drying quality that is equal to the drying quality under the drying condition with the sheet of 130 gsm (i.e., the void ratio "Good") can be obtained.

In Evaluation Tests 1 and 2, it was found that the void ratio is "Not Good" (i.e., the ratio exceeded 0.03%) even when the heating temperatures of the heat rollers 11 are set greater than the heating temperature of the heat drum 12. This inconvenience occurred due to an increase in the temperatures of the guide rollers 13 by receiving heat from the continuous sheet 110.

Therefore, in order to further improve the mold release force on the surface of the guide roller 13, the following two processes were performed.

Fluororesin Coating.

As a fluorine resin, it is preferable to include, for example, tetrafluoroethylene-perfluoalkylvinylether copolymer (PFA, melting point: 300° C. to 310° C.), polytetrafluoroethylene (PTFE, melting point: 330° C.), tetrafluoroethylene-hexafluoropropylene copolymer (FEP, melting point: 250° C. to 280° C.), ethylene tetrafluoroethylene copolymer (ETFE, melting point: 260° C. to 270° C.), polyvinylidene fluoride (PVDF, melting point: 160° C. to 180° C.), polychlorotrifluoroethylene (PCTFE, melting point: 210° C.), tetrafluoroethylene-hexafluoropropylene-perfluoalkylvinylether copolymer (EPE, melting point: 290° C. to 300° C.), and copolymers containing these polymers. It is more preferable to include polytetrafluoroethylene (PTFE).

After the blasting treatment was provided to respective circumferential surfaces of the guide rollers 13 made of aluminum, a primer material was applied onto the circumferential surface of the guide rollers 13, and a fluororesin material was applied to coat the circumferential surface of the guide rollers 13. Then, the guide rollers 13 were heated and burnt. In other words, the circumferential surfaces of the guide rollers 13 were coated with fluororesin. The film thickness was set to 100 μm or above. It is to be noted that the number of the guide rollers 13 to be coated with fluororesin may be one or more guide rollers.

PFA Tube.

The circumferential surfaces of the guide rollers 13 were covered by a PFA heat-shrinkable fluororesin tube. Hot air was applied to the guide rollers 13 to cause heat shrink to cover the surface layer of the guide rollers 13. As a PFA tube, GRC-65P (having the thickness of 0.5 mm, the inner diameter of 67 mm before the shrink, and the inner diameter of 54 mm after the shrink) manufactured by Gunze Limited. was used. It is to be noted that the number of the guide rollers 13 to be covered by the PFA tube may be one or more guide rollers.

Next, Evaluation Test 3 was conducted with the guide rollers 13 covered by the above-described fluororesin coating or by the PFA tube. Specifically, The results are indicated in Table 3 (specifically, the same results were obtained when conducted with the guide rollers 13 coated by the above-described fluororesin and the guide rollers 13 covered by the PFA tube).

Under the dry standard conditions with the roll sheet of 130 gsm and the void ratio "Good", even when the heating temperature of the heat rollers 11 and the heating temperature of the heat drum 12 are dropped to 100° C., respectively, while the guide rollers 13A, 13B, and 13C are replaced to the PFA tube covered rollers and the other guide rollers including the guide roller 13D, disposed downstream from the guide roller D in the sheet conveying direction are not replaced from the aluminum surface roller, the void ratio resulted as "Good."

Next, the evaluation test was conducted under the conditions modified as follows: the continuous sheet is a roll sheet of 250 gsm at the conveying speed of 120 m/min.; 7 guide rollers, i.e., the guide rollers 13A to 13G are replaced to PFA tube covered rollers; the downstream side guide rollers, i.e., the guide rollers after the guide roller 13F are remained as rollers with the aluminum surface; the heating temperature of the heat drum 12 is remained at 100° C.; and the heating temperatures of the heat rollers 11 are changed to 150° C. The evaluation test with the above-described conditions resulted in "Good" in the void ratio.

TABLE 3

| | Weight of Roll Sheet (Unit: gsm) | | | | | |
|---|---|---|---|---|---|---|
| | 130 | 130 | 250 | 250 | 250 | 250 |
| Contact Guide Roller | Aluminum Surface | PFA Tube | PFA Tube | PFA Tube | PFA Tube | PFA Tube |
| (Target Roller(s)) | — | 1st to 3rd | — | — | — | 1st to 7th |
| Conveying Speed (Unit: m/min.) | 75 | 120 | 120 | 120 | 120 | 120 |
| Temperature of Heat Drum (Unit: ° C.) | 120 | 100 | 100 | 100 | 100 | 100 |
| Temperature of Heat Rollers (Unit: ° C.) | 120 | 100 | 100 | 120 | 140 | 150 |
| Void Ratio | Good | Good | Not Good | Not Good | Not Good | Good |

In each of the above-described embodiments, the example in which the drying target object to be conveyed is a continuous sheet has been described. However, embodiments of this disclosure are not limited to the continuous sheet as long as the object is dried by the drying device according to this disclosure. Examples of a drying target object include a continuous body such as a continuous sheet, roll paper, or a web, a recording medium (print target object) such as a long sheet material, wall paper, and a printing material such as an electronic circuit board sheet such as a prepreg.

In addition to recording an image such as a letter or a figure with a liquid such as an ink, an image having no meaning, such as a pattern, may be applied to a drying target object to be conveyed in a printer, with a liquid such as an ink for the purpose of decoration or the like.

In this disclosure, the liquid to be applied to a drying target object to be dried is not particularly limited. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

In a case in which the liquid discharging head is used as a liquid applying unit, examples of an energy source for generating energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

It is to be noted that image formation, recording, letter printing, and photograph printing are all synonymous in the printing in this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A drying device comprising:

one or more first heating bodies configured to heat a drying target object conveyed with liquid applied on the drying target object;

one or more contact guides disposed downstream from the one or more first heating bodies and configured to contact a liquid applied face of the drying target object, with the liquid applied on the liquid applied face, and to guide the drying target object; and a second heating body disposed in a path between the one or more first heating bodies and the one or more contact guides, the second heating body configured to heat the drying target object after the drying target object is heated by the one or more first heating bodies, and to turn the drying target object from a first path along the one or more first heating bodies to a second path along the one or more contact guides, the one or more first heating bodies including at least one first heating body configured to heat the drying target object at a heating temperature greater than a heating temperature of the second heating body, the one or more first heating bodies are disposed in an arc shape and arranged radially about the second heating body, and the one or more first heating bodies are configured to collectively guide the drying target object with the arc shape for less than one circular revolution of the drying target object prior to the drying target object reaching the second heating body.

2. The drying device according to claim 1, further comprising:

a first temperature detector configured to detect a heating temperature of the one or more first heating bodies;

a second temperature detector configured to detect a heating temperature of the second heating body; and circuitry configured to control the heating temperature of the one or more first heating bodies and the heating temperature of the second heating body based on a detection result of the first temperature detector and a detection result of the second temperature detector.

3. The drying device according to claim 1, further comprising a passage in which the drying target object is heated while contacting the one or more first heating bodies for two times.

4. The drying device according to claim 1, wherein the one or more contact guides includes at least one guide roller, and wherein a circumferential surface of the at least one guide roller is coated with fluororesin.

5. The drying device according to claim 1, one or more contact guides includes at least one guide roller, and wherein a circumferential surface of the at least one guide roller is covered by a fluororesin tube.

6. The drying device according to claim 1, further comprising circuitry configured to control the heating temperature of the one or more first heating bodies and the heating temperature of the second heating body based on information of the drying target object.

7. The drying device according to claim 1, further comprising circuitry configured to control the heating temperature of the one or more first heating bodies and the heating temperature of the second heating body based on information of a conveying speed of the drying target object.

8. A printer comprising:

a liquid applier to apply liquid to a drying target object; and the drying device according to claim 1.

9. The drying device according to claim 1, wherein the one or more first heating bodies are configured to collectively guide the drying target object with the arc shape for less than one circular revolution of the drying target object as the drying target object travels away from the second heating body.

* * * * *